US009321617B2

(12) United States Patent
Sandvik

(10) Patent No.: US 9,321,617 B2
(45) Date of Patent: Apr. 26, 2016

(54) DEVICE FOR TIGHTENING ROPE

(75) Inventor: Karl Fredrik Sandvik, Hareid (NO)

(73) Assignee: FLAMEK LTD, Hareid (DE)

( * ) Notice: Subject to any disclaimer, the term of this patent is extended or adjusted under 35 U.S.C. 154(b) by 97 days.

(21) Appl. No.: 14/003,441

(22) PCT Filed: Mar. 23, 2012

(86) PCT No.: PCT/NO2012/000031

§ 371 (c)(1),
(2), (4) Date: Sep. 12, 2013

(87) PCT Pub. No.: WO2012/128637

PCT Pub. Date: Sep. 27, 2012

(65) Prior Publication Data

US 2013/0341453 A1 Dec. 26, 2013

(30) Foreign Application Priority Data

Mar. 23, 2011 (NO) ..... 20110436

(51) Int. Cl.
*B66D 1/52* (2006.01)
*B66D 1/74* (2006.01)
*B66D 1/50* (2006.01)

(52) U.S. Cl.
CPC .. *B66D 1/52* (2013.01); *B66D 1/50* (2013.01); *B66D 1/7415* (2013.01)

(58) Field of Classification Search
CPC ..... B66D 1/52; B66D 1/50; B66D 1/7415
USPC ..... 242/419.6–419.9; 226/180, 108; 254/393–395, 397
See application file for complete search history.

(56) References Cited

U.S. PATENT DOCUMENTS 1,140,460 A * 5/1915 Jaeger ..... 242/419.7
2,756,872 A * 7/1956 Hartley ..... 226/112
2,756,873 A * 7/1956 Hartley ..... 226/112

(Continued)

FOREIGN PATENT DOCUMENTS

DE 1107311 B 5/1961
FR 448630 A 2/1913

(Continued)

OTHER PUBLICATIONS

International search report in application No. PCT/N02012/000031 dated Jul. 23, 2012.

(Continued)

*Primary Examiner* — Emmanuel M Marcelo
*Assistant Examiner* — Justin Stefanon
(74) *Attorney, Agent, or Firm* — Oppedahl Patent Law Firm LLC

(57) ABSTRACT

A device for tensioning of a rope, the device comprising two or more sheaves (6, 6'), each sheave (6, 6') being operated by a motor (7, 7'), where a rope (10) to be tensioned may be arranged so that it sequentially rests against the contact surface of the sheaves of the device. The sheaves (6, 6') are arranged in pairs on a rotatable support (2), where the axes of rotation of the sheaves and the turntable are substantially parallel. The sheaves have a first position in which the rope (10) may pass unhindered between the sheaves (6, 6') of the pair, and be rotated by said support (2) to second position in which the rope (10) has been wound to a substantial contact angle about the sheaves.

15 Claims, 5 Drawing Sheets

(56) References Cited

U.S. PATENT DOCUMENTS

| | | | | |
|---|---|---|---|---|
| 3,246,818 | A * | 4/1966 | Davis | 226/90 |
| 3,722,776 | A * | 3/1973 | Noe | 226/195 |
| 3,885,604 | A * | 5/1975 | Rowland | 140/3 C |
| 4,217,085 | A * | 8/1980 | Ljungberg et al. | 425/335 |
| 4,576,100 | A * | 3/1986 | Zanin | G21C 19/32 105/163.1 |
| 4,760,992 | A * | 8/1988 | Peppel et al. | 254/277 |
| 4,846,446 | A * | 7/1989 | Peppel et al. | 254/277 |
| 7,134,645 | B1 * | 11/2006 | Johnson et al. | 254/338 |
| 8,322,691 | B2 * | 12/2012 | Boussaton et al. | 254/278 |
| 8,746,101 | B2 * | 6/2014 | Hausladen | B66C 23/86 192/150 |
| 2013/0082223 | A1 * | 4/2013 | Kippernes et al. | 254/277 |
| 2014/0021421 | A1 * | 1/2014 | Torben | 254/277 |

FOREIGN PATENT DOCUMENTS

| | | | | |
|---|---|---|---|---|
| WO | 83/03814 | A1 | 11/1983 | |
| WO | 2011/139160 | A1 | 11/2011 | |
| WO | WO 2011139160 | A1 * | 11/2011 | B66D 1/50 |

OTHER PUBLICATIONS

Written opinion in application No. PCT/N02012/000031 dated Jul. 23, 2012.

* cited by examiner

DEVICE FOR TIGHTENING ROPE

TECHNICAL FIELD

The present invention relates to a device for tensioning an elongated body, such as a cable, wire or rope, and most specifically a rope that is to be spooled onto a winch. The present device may be used for the initial spooling of a rope onto a winch drum or for maintaining a tension of the rope being re-spooled onto the winch drum during an operation where the tension in the rope from the load is too low.

BACKGROUND ART

Essential to the understanding of how the tension force in a rope is established through a sheave is the well-known "Rope Friction Formula": if a tension force F2 is applied to one end of a rope that is spooled about a sheave, the rope will slide off the sheave unless there is a tension force F1 applied to the other end. The relation between the F1 and F2 is given by the "Rope Friction Formula"

$$F2=F1*e^{\mu\alpha}$$

where μ is the coefficient of friction between rope and sheave, and α is the angle in radians taken from F1 to F2 (The radius of the sheave is without influence if the bending stiffness of the rope is low). Given one full turn and μ=0.2, F2=F1*3.5. Given 5 full turns, F2=535*F1. The factor would still be the same with 10 sheaves and half a turn round each in the latter case.

A rope being spooled onto a winch for lifting operations and the like is spooled onto the winch drum at a predetermined tension. Variation of tension of the rope being spooled in layers at the drum may cause serious problems, as the rope in an overlaying layer may "cut into" an underlying layer when a high load is applied to the rope. This will cause problems to the spooling and will also have a detrimental effect on the rope itself. Normally, such an incident makes it necessary to stop the operation to correct the problem.

To avoid this problem, a traction winch is normally used in cases where the tension in the rope to be spooled onto the winch drum is significantly lower than the tension to the rope when the rope is spooled off the winch drum. The traction winch is then dimensioned to have a lifting capacity being equivalent to the maximum lifting capacity of the system. The tension of the rope entering the drum of the winch may then be kept sufficiently constant even if the load of the rope entering the system varies substantially.

Negative features related to existing systems are that the systems are expensive and the systems occupy a large space on board a vessel where space and weight are expensive.

A significant drawback of present tension control systems is the many bending cycles of bending of the rope or cable under load, and in particular when the system is used to compensate for waves (heave compensation). After a heavy payload has been lowered onto the seabed, the cable will be retrieved. When retrieving the cable, heave compensation will not be needed, but the proper tension when spooling the cable onto the winch drum must be maintained. With most present tension control systems, the cable must pass the system regardless whether there is a need for tension control or not.

Also, a major drawback with existing tension control systems is that they are not easily integrated with existing winches.

Cables, and in particular those utilized in the offshore industry, add an extra challenge with respect to spooling, as they may have a main body interspersed with segments of diverse cross section and/or bending stiffness due to integrated devices like hydrophones or magnetic sensors (hereinafter "segmented cables"). These segments may have a cross section that does not fit the groves in sheaves and drums laid out for the main bulk of the cable, and such segments may easily become damaged if they are bent beyond a limit. In operation, segmented cables are spooled onto a drum of large diameter (e.g. 4 meters or more) at low tension to avoid excessive bending.

WO 2011/139160 A1 discloses a tension control device for an anchor line rope of large diameter having two movable link arms connecting to a fixed link arm, the movable arms being operated by hydraulic cylinders. Each link arm is carrying a sheave operated by a hydraulic motor. However, WO 2011/139160 A1 does not allow for attaching to a cable under tension and does not allow for segmented cables without significantly bending the cable.

An object of the present invention is to provide a solution where the above-mentioned problems are solved. Other objects of the present invention will be obvious after studying the present description.

In the present description the term "rope" has been used for an elongated body. The elongated body mentioned by the term "rope" may be a rope, a wire or a cable. Presently, the most preferred elongated body is a rope, especially a fibre rope made of synthetic fibres.

SUMMARY OF THE INVENTION

The present invention relates to a device for tensioning of a rope, the device comprising two or more sheaves, each sheave being operated by a motor having a breaking capability, where a rope to be tensioned may be arranged so that it sequentially rests against the sheave surface of the sheaves of the device, the sheaves being movable in order to vary the contact angle of the rope around each sheave, characterized in that the sheaves are arranged in pairs on a rotatable support, said rotatable support being rotatable between a first rotational position in which the rope may pass unhindered between the pair of sheaves, and a second, variable rotational position in which the rope has been wound to a substantially equal contact angle about the sheaves.

Arranging sheaves as specified above makes it possible to change from an inactivated position to an activated position for the sheaves, where the rope runs between the sheaves in a pair of sheaves when the device is in an inactivated position, and where the rope is caused to run in a zigzag manner resting against the surfaces of the sheaves when the device is in an activated position. In the inactivated position, the rope is allowed to go through the device without bending and without any friction against any parts of the tensioning device. In the activated position, great tensioning force is ascertained by the rope resting against a substantial part of the outer surface of the sheaves to provide maximum friction between the rope and the sheaves of the tensioning device.

To achieve the required tensioning force and friction between the rope and the present device, it may be necessary for the device to comprise two or more turntables, each provided with a pair of sheaves as described above. If the axes of rotation of the turntables define a common plane, a rope arranged in this plane may pass through the device without needing to touch any of the sheaves when the device is in an inactivated position.

According to one embodiment, the device additionally comprises guide sheaves. The guide sheaves may be used to avoid sideways displacement of the rope during the activation or deactivation operation.

According to a specific embodiment, the motors of the sheaves, which also act as brakes, are independently operated. By independently controlling the breaking force of each sheave, it is possible to avoid, or at least reduce, the risk of local high load in the rope that may be damaging to the rope.

According to one embodiment, the turntables may be independently operated. By independently operating the turntables in a row of turntables, it is possible to adopt the number of sheaves for tensioning of the rope to the number of sheaves that is necessary to obtain the required breaking force without the risk of slippage, at the same time as the number of active sheaves are kept at a minimum to avoid excessive wear of the rope.

According to a different embodiment, two or more turntables are operated by one common actuator. Operation of two or more turntables by a common actuator makes it possible to simplify the construction of the device and to reduce the number of actuators.

In the following, the present invention will be further described with reference to the enclosed schematic drawings showing exemplifying embodiments of the present invention.

DETAILED DESCRIPTION OF THE INVENTION

Figure 1:
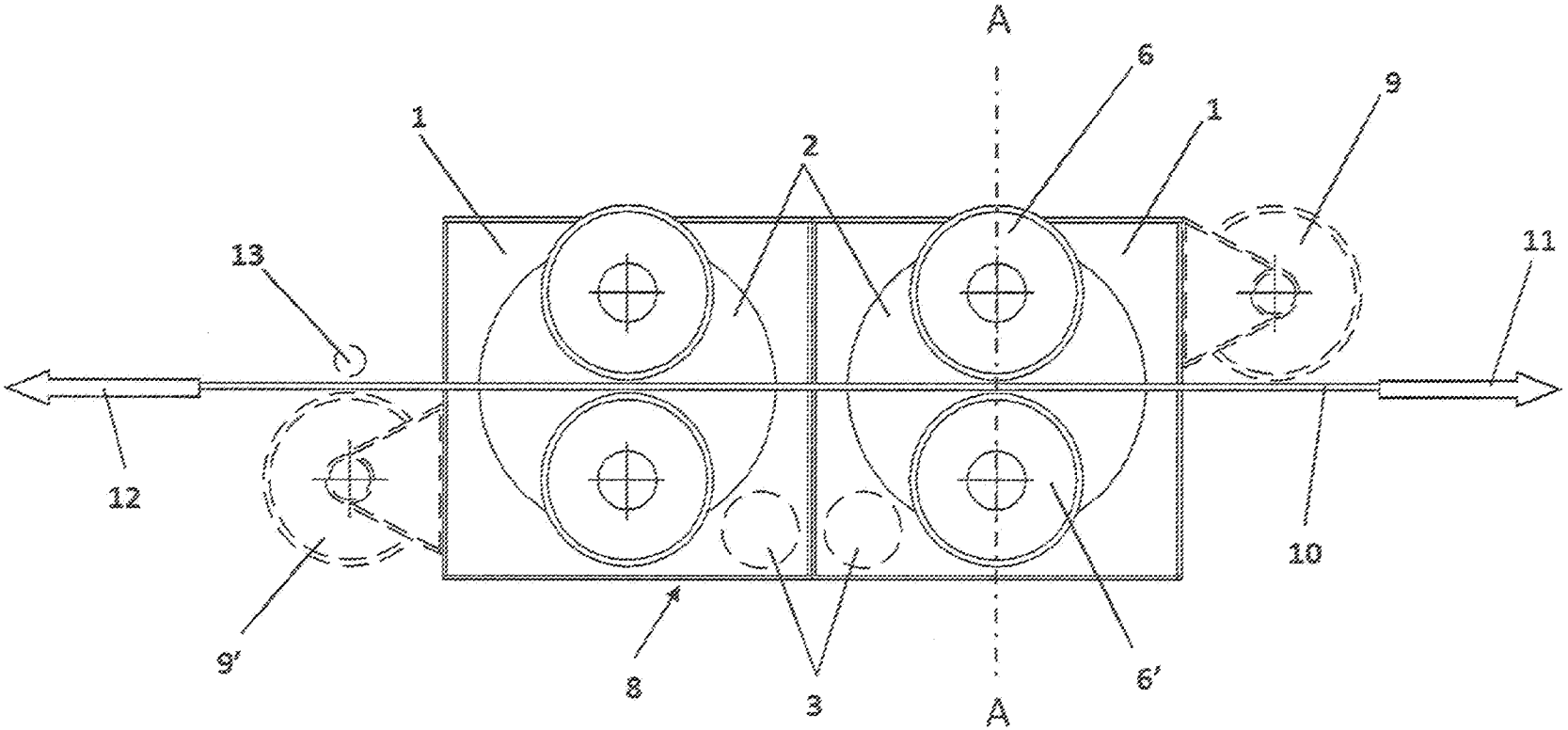
FIG. 1 is principle sketch of a first device according to the present invention in a first, or inactivated position.
Figure 2:
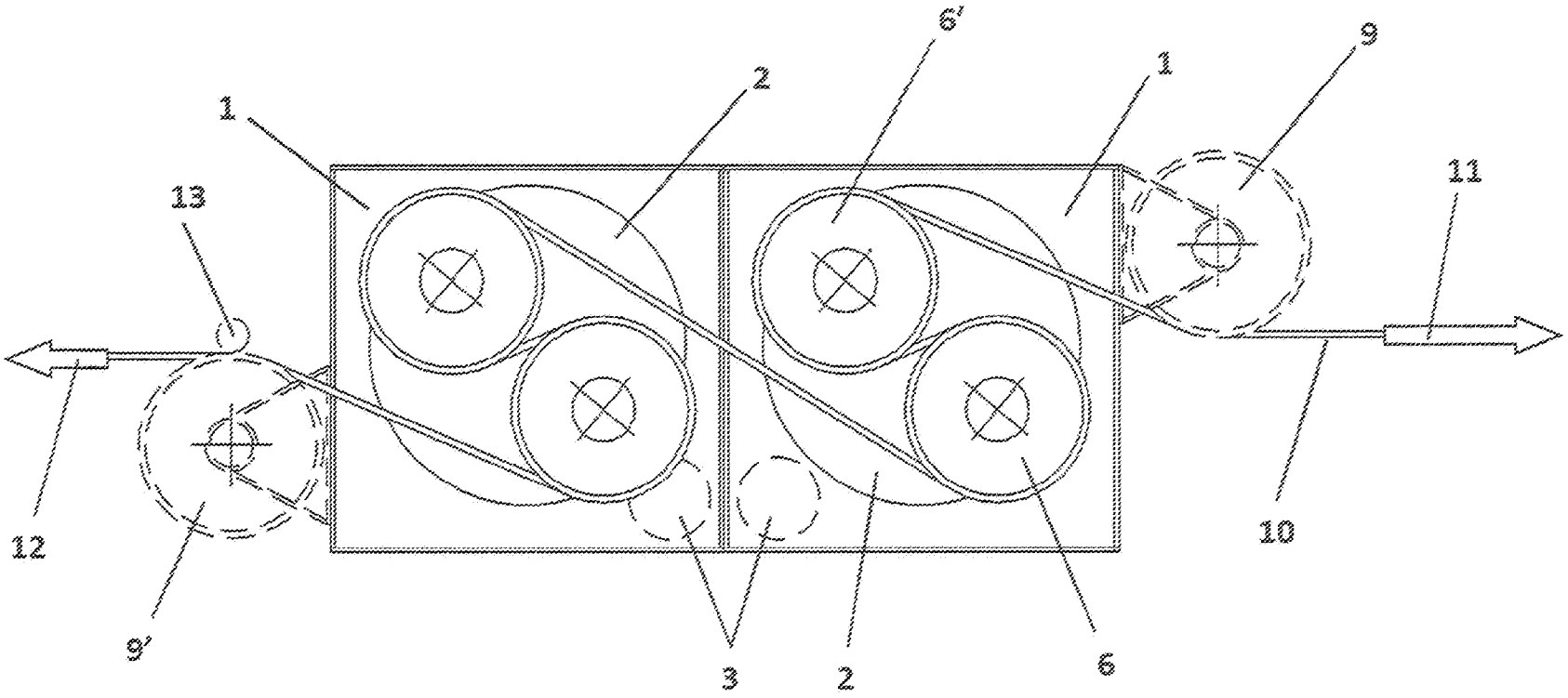
FIG. 2 illustrates the device of FIG. 1 in an activated position.

FIG. 1 illustrates the present device in a first, or inactivated, position. A main body 1 is connected to any suitable structure to support the device on board a vessel. The main body may be fixed directly to ship structures or may be movably connected, e.g. movably connected to the deck so that the present tensioning device may be displaced along or across the path of the rope. The illustrated main body 1 is a rectangular plate having a base for fixing of the main body to a ship structure, such as the deck.

One or more rotatable supports 2, here in the form of turntables, are arranged on the main body 1. The turntables 2 may be rotated by means of one or more motor(s) or actuators 3, as described below. Alternatively, two or more turntables may be rotated by one common motor or actuator.

The turntables 2 comprise a static member 4 and a rotary member 5. The static member 4 is fixed to the main body 1 and can comprise a so-called slewing ring, and the rotary member is rotatably arranged on the static member 5 about an axis of rotation 14 that is substantially perpendicular to the main body. The device illustrated has two turntables. If two or more turntables are present on the device, the axes of rotation 14 of the turntables are parallel and usually lie in a common plane.

Two sheaves 6, 6' are arranged on each of the rotatable supports 2, both having an axis of rotation that is substantially parallel to the axis of rotation 14 of the turntable(s). The two sheaves are arranged on a common diameter of the turntable 2, one on either side of and at equal distance to the axis of rotation 14 for the turntable 2 and with a distance to each other to allow a rope to be placed or removed by displacement in the direction of the axis of rotation. The drums 6, 6' are operated by motors 7, 7', such as electrical or hydraulic motors that also act as brakes.

One turntable 2 with two sheaves 6, 6' arranged on the main body 1 is in the following called one tensioning unit 8. Preferably, the present tensioning device comprises two or more tensioning units 8. The number of units depends on the type of rope that is to be used with the device, the required lifting capacity for the winch, and the difference in tension for the intended use.

When the present tensioning device is in its open position, the common diameter of the turntable on which the sheaves 6, 6' are arranged, is substantially perpendicular to the common plane defined by the axis of rotation 14 of the turntables. A rope 10 may then be placed between the sheaves 6, 6' of each of the tensioning units 8 as illustrated in FIG. 1. Arrows 11, 12 indicate the direction towards the winch drum (winch side, arrow 11), and the direction towards the load (load side, arrow 12).

When the present device is to be activated, the turntables 2 are rotated in the same direction, such as counter clockwise as in the illustrated embodiment. The rope 10 will then be brought into a path where the rope rests against the surfaces of both sheaves 6, 6' in a zigzag pattern. The number of zigzag movements depends on the number of tensioning units 8. The contact angle between the rope and each sheave can be quite substantial, in the range of 210 to 250 degrees or more, depending i.a. on the thickness of the rope. A range of 220 to 230 degree is normally obtainable.

Guide sheaves 9, 9' are preferably provided at the winch side 11 and the load side 12, respectively, to control the direction of the rope on both sides. The guide sheaves 9, 9' may also be provided with motors, if necessary. A displaceable roller 13 may be provided if more tensioning capacity is needed.

The rotation of the sheaves may then be controlled by the motors 7, 7'. The tensioning device is normally used for spooling up rope when the load at the load side is lower than the required tension for spooling onto the winch drum. The motors 7, 7' are therefore normally used as brakes for the rope to avoid spooling the rope up on the drum at low tension. Preferably, the motors of the different sheaves are operated independently of each other. Independent operation allows for adjusting the braking force according to the need and to compensate for elongation/shortening of the rope running through the device due to the elasticity of the rope and the difference in load on the rope through the device.

When there is no need for tensioning, the tensioning device will be set in the open, or inactivated position. The device may then be activated on short notice, if needed.

In case of segmented cables, their segments may be passed by employing devises according to the invention with sufficient spacing to provide room for the segment between the devices. When a segment arrives, the first device is placed in inactivated position until the segment has passed. Thereafter the first device is reactivated and the next device opened to let the segment pass.

Figure 3:
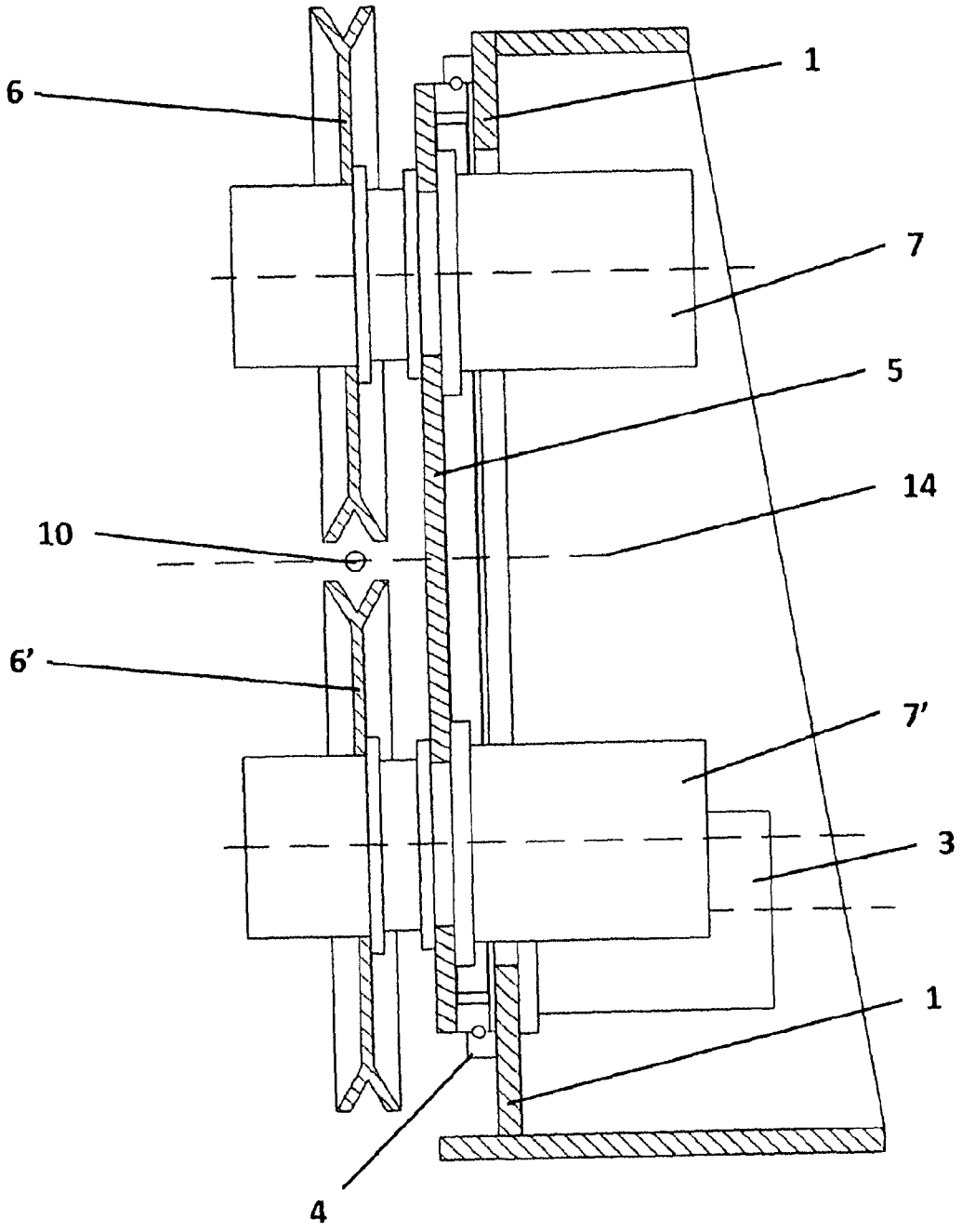
FIG. 3 is a cross section along A-A in FIG. 1.
Figure 4:
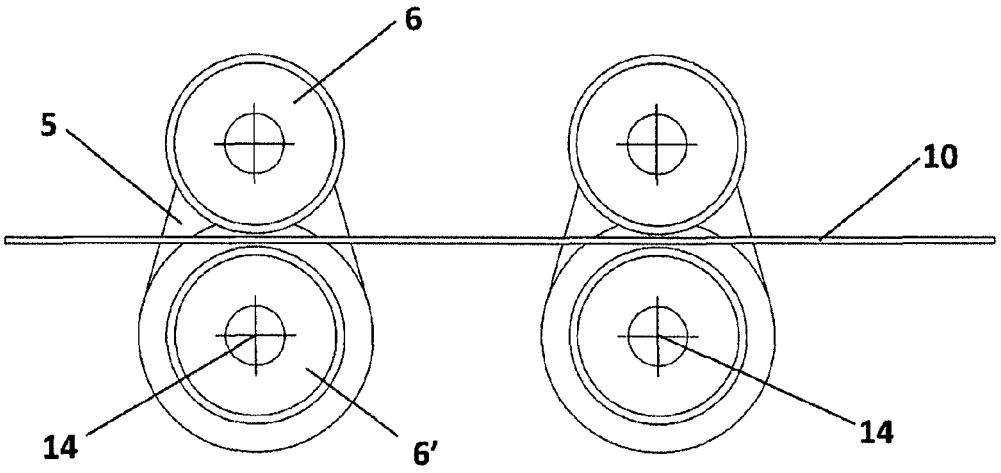
FIG. 4 is schematic view illustrating a second embodiment of the invention in an inactivated position.
Figure 5:
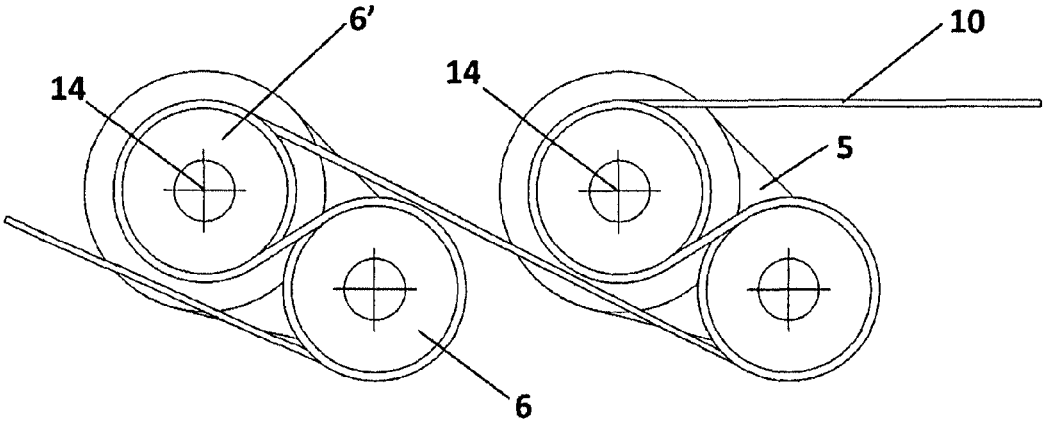
FIG. 5 is a schematic view illustrating the embodiment in FIG. 4 in an activated position.

FIGS. 4 and 5 illustrate a further embodiment of the invention. The rotatable support 5 for the sheaves 6, 6' here takes the form of an arm of plate material. The components for rotating the support 5 are located at one end of the support and may take a form similar to that of FIG. 3, e.g. with a slewing ring and driving motor. One of the sheaves 6' is arranged with its axis of rotation coincident with the axis of rotation 14 of the support arm 5. The other sheave 6 is arranged at the opposite end of the support arm. Upon bringing the device from inactivated to activated condition, the support arm 5 is rotated counterclockwise from the position in FIG. 4 to the position in FIG. 5.

Figure 6:
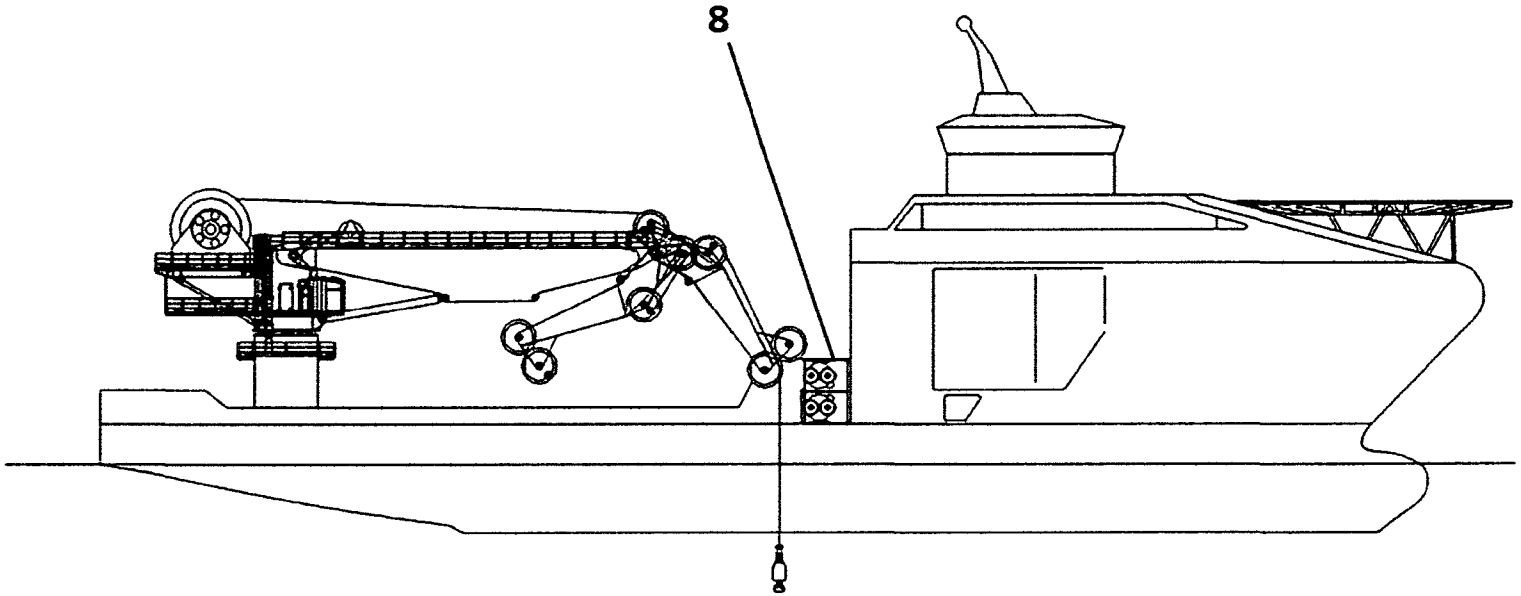
FIG. 6 is an elevation of a ship provided with a device according to the invention at the side thereof.

FIG. 6 shows a ship provided with a crane and a device 8 according to the invention oriented vertically and mounted pivotally about a vertical axis at the side of the ship so that it may be swung outwards to reach over the side of the ship. In this position, the crane may move to place its hoisting wire sidewise into the gap between the sheaves 6, 6' in their inactivated condition and have the wire engaged by the sheaves by moving them to their activated condition.

The tensioning devices according to the invention may be arranged so that all axes of rotation of the sheaves and turntables are substantially horizontal, or parallel to the deck of the vessel, or it may be arranged so that the main body is substantially horisontal, or parallel to the deck and the axes of rotation are substantially vertical.

The skilled person will understand that for tensioning devices having two or more tensioning units, the tensioning units may be operated independently. To avoid unnecessary bending of the rope, it may be preferred to activate the number of tensioning units that are necessary for the given task, and leave the remaining units in their inactivated position.

Although a slewing ring has been shown as the means for rotating the rotatable support, the skilled person will understand that other means are available for this function, e.g. a pair of jacks acting on a crank fixed to the support.

The skilled person will also understand that the breaking power of the motors may be transformed to usable energy, e.g. electrical energy that may be used for other purposes on board the vessel. Furthermore, the present invention is not limited to the exemplifying embodiments described herein, by may be varied and modified by the skilled person within the scope of the following claims.

The invention claimed is:

1. A device for tensioning of a rope, the device comprising a plurality of sheaves, each sheave being operated by a separate motor having a braking capability, where a rope to be tensioned is arranged so that it sequentially rests with a contact angle against the sheave surface of the sheaves of the device, the sheaves being movable in order to vary the contact angle of the rope around each sheave, wherein the sheaves are arranged in pairs on a rotatable support, said rotatable support being rotatable between a first rotational position in which the rope may pass unhindered between the pair of sheaves, and a second, variable rotational position in which the rope has been wound to a substantially equal contact angle about the sheaves, and wherein a slewing ring in the form of a rolling-element bearing, thin in section and with a diameter of one meter or more, is arranged between the rotatable support and a stationary main body for providing a rotatable connection there between.

2. The device of claim 1, wherein the contact angle is variable up to a range of 210 to 250 degrees for each sheave.

3. The device of claim 1, additionally comprising guide sheaves which are separate from the sheaves of the device and located at opposite sides of a common carrier.

4. The device of claim 1, wherein the motors of the sheaves are independently operated.

5. The device of claim 1, wherein the rotatable supports are independently operated.

6. The device of claim 1, wherein two or more rotatable supports are operated by one common actuator.

7. The device of claim 1, wherein axes of rotation of the sheaves are placed on either side of the axis of rotation of the rotatable support and equidistant therefrom.

8. The device of claim 1, wherein axis of rotation of one of the sheaves coincides with the axis of rotation of the rotatable support.

9. The device according to claim 1, wherein the device is oriented vertically and is pivotally mounted about a vertical axis onto a starboard or port side of a hull of a ship so that it can be swung out from said side of the ship.

10. The device according to claim 1, comprising at least two rotatable supports arranged on a common carrier.

11. The device according to claim 1, wherein the rotatable support has circular form with a peripheral portion, to which a first race of the rolling-element bearing is attached, a second race of the rolling-element bearing being attached to the stationary main body.

12. The device according to claim 1, wherein the rolling-element bearing comprises an outer race and an inner race with rolling elements there-between, the outer race being fixed to the stationary main body and the inner race being fixed to the rotatable support, the inner race having an inner surface provided with teeth for engagement with an actuator fixed to the stationary main body for rotating the rotatable support with respect to the stationary main body.

13. The device according to claim 12, wherein the motors of the sheaves extend through the rolling-element bearing and an adjacent opening in the stationary main body to allow the motors to orbit therein upon rotation of the rotatable support.

14. The device according to claim 1, wherein the rotatable support comprises a plate having a front side and a rear side, to which plate the sheaves with their respective motors are mounted, the sheaves being located on the front side of the plate and their motors on the rear side of the plate, each sheave and motor forming a concentric unit penetrating the plate.

15. The device according to claim 1, wherein the rotatable support comprises a slewing ring.

* * * * *